United States Patent [19]

Proepper

[11] Patent Number: 4,611,454

[45] Date of Patent: Sep. 16, 1986

[54] CAPPING MACHINE

[75] Inventor: Wilhelm Proepper, Langenfeld, Fed. Rep. of Germany

[73] Assignee: Benz & Hilgers GmbH, Duesseldorf, Fed. Rep. of Germany

[21] Appl. No.: 742,625

[22] Filed: Jun. 7, 1985

[30] Foreign Application Priority Data

Jun. 7, 1984 [DE] Fed. Rep. of Germany ..... 3421177

[51] Int. Cl.[4] ..... B65B 7/28; B67B 3/00

[52] U.S. Cl. ..... 53/307

[58] Field of Search ..... 53/307, 306, 301, 302, 53/303

[56] References Cited

U.S. PATENT DOCUMENTS

| | | | |
|---|---|---|---|
| 3,064,407 | 11/1962 | Logemann et al. | 53/307 |
| 3,293,823 | 12/1966 | Anderson | 53/307 X |
| 3,487,622 | 1/1970 | Mueller | 53/307 X |
| 3,509,682 | 5/1970 | Logemann | 53/307 X |

*Primary Examiner*—Horace M. Culver

[57] ABSTRACT

A capping machine has a housing defining a capping station, a conveyor for transporting a longitudinally extending row of vessels through the station, and a magazine holding a supply of caps above the capping station. A gripper shaft extends along a transverse shaft axis in the station beneath the supply and carries at least one gripper that can cling to the caps in the magazine, typically by magnetic or pneumatic action. A rod fixed on and extending radially from the shaft can slide in a crosshead pivotal on the housing. A vertical guide on the housing vertically reciprocally receives the shaft. A drive connected between the shaft and the housing vertically displaces the shaft along the slot between upper and lower positions. The rod and crosshead are constructed such that on such vertical displacement the shaft is rotated between one end position corresponding to the upper shaft position with the gripper engaged upward against the cap supply and an opposite end position corresponding to the lower shaft position with the gripper beneath the shaft and holding a cap picked off the supply above a vessel on the belt in the station.

12 Claims, 2 Drawing Figures

CAPPING MACHINE

FIELD OF THE INVENTION

The present invention relates to a capping machine. More particularly this invention concerns an apparatus which puts caps or covers on vessels immediately after they are filled in a packaging operation.

BACKGROUND OF THE INVENTION

In a packaging operation a horizontal conveyor belt extends in a longitudinal travel direction through a filling machine and then through a capping machine. A longitudinal row of upwardly open vessels sitting on the belt is stepped through the two machines. In the filling machine each vessel is filled with whatever material, a foodstuff for instance, that it is to contain. In the capping machine the cover is applied to the top of the filled vessel. Other machines downstream of the capper can seal the package thus formed and label it while upstream of the filling machine other devices are loading the vessels onto the belt and otherwise preparing them for filling.

This capping machine normally holds a stack of upside-down caps or covers. A suction-type gripper or the like is carried on a shaft that extends horizontally perpendicular to the transport direction. The shaft can be moved angularly, that is rotated, about its axis to move the gripper in an arc centered on the shaft axis and can be moved perpendicular to this direction, translatory movement.

Synchronously with the stepwise advance of the vessels through the capping machine the shaft is moved up to press the gripper up against the lowermost cover in the supply stack and adhere it thereto. Then the shaft is lowered to pull the gripper down and free this lowermost cover from the stack and at the same time the shaft rotates to move the gripper through a 180° arc and position the cap right-side-up over the vessel underneath it in the capping station. The shaft and gripper are then moved down to fit the cover to the vessel. Thereafter the capped vessel is moved away while the gripper reverses, moving up and inverting to start the cycle over again.

This combined rotation/translation of the shaft carrying the gripper necessitates a fairly complex drive system which must work at relatively high speed in a standard mass-production packaging operation. In a multiline system where several parallel rows of vessels are stepped simultaneously through the filling and capping machines the assembly of the shaft with its grippers becomes somewhat massive, complicating the problem of moving it accurately and rapidly.

In German Pat. No. 3,111,896 the shaft carrying the gripper shaft is journaled in a vertically displaceable frame and is provided on one end with a wheel. A vertical row of bumps on a stationary support or guide can engage in a corresponding row of hollows in the rim of the wheel and rotate it as the frame moves up and down, the wheel diameter being such that the vertical stroke of the frame is about equal to one-half of its circumference. In the side of the wheel rim opposite the row of recesses there is a guide groove extending radially of the shaft. A lower cam and a central cam can fit into this groove as it moves up and down. Thus with each vertical displacement of the frame the shaft is rotated through 180°. The problem with this arrangement is that it operates in a very jerky manner and is quite noisy, especially when operating at high speed.

Another arrangement described in German patent document No. 3,037,455 has a shaft that can rotate and be vertically reciprocated, and that carries for each of several parallel rows of vessels to be capped a holder having several arms projecting radially from the shaft and each carrying a respective cap gripper. A separate vertically effective actuator is needed to move such a massive shaft assembly up and down. In addition the pneumatic control of the various grippers necessitates complex valve equipment and considerable pump capacity. As a result this type of unit is a frequent service problem.

OBJECTS OF THE INVENTION

It is therefore an object of the present invention to provide an improved capping machine.

Another object is the provision of such a capping machine which overcomes the above-given disadvantages, that is which accurately moves the gripper with the required combination of rotary and translatory motion but that is fairly simple, troublefree, and quiet in operation.

SUMMARY OF THE INVENTION

A capping machine according to the invention has a housing defining a capping station, a conveyor for transporting a longitudinally extending row of the vessels through the station, and a magazine holding a supply of the caps on the housing above the capping station. A gripper shaft extends along a transverse shaft axis in the station beneath the supply and carries at least one gripper that can cling to the caps in the magazine, typically by magnetic or pneumatic action. A rod fixed on and extending radially from the shaft can slide in a crosshead pivotal on the housing. A vertical guide on the housing vertically reciprocally receives the shaft. A drive connected between the shaft and the housing vertically displaces the shaft along the slot between upper and lower positions. The rod and crosshead are constructed such that on such vertical displacement the shaft is rotated between one end position corresponding to the upper shaft position with the gripper engaged upward against the cap supply and an opposite end position corresponding to the lower shaft position with the gripper beneath the shaft and holding a cap picked off the supply above a vessel on the belt in the station.

Thus the drive means includes a sliding-action linkage for effecting the vertical displacement and a sliding-bar linkage for effecting the rotation. These types of linkages are of the continuous-contact type so that the machine according to this invention will operate very smoothly and quietly. Furthermore the overall vertical stroke can be relatively short and still sufficient to allow the necessary inversion of the gripper and shaft.

According to another feature of this invention the guide is a vertically extending slot formed in the housing and the sliding-action linkage includes a roller carried on the shaft and snugly fitted in the slot. In addition the sliding-bar linkage includes a rod fixed on and extending radially from the shaft and a crosshead pivotal on the housing and slidably receiving the rod. Such structure is extremely simple and troublefree. In addition the lack of complexly toothed or machined parts makes the system fairly inexpensive to manufacture.

In accordance with another feature of this invention the slot has straight and vertical upper and lower portions and a V-shaped center portion therebetween having inclined upper and lower legs that meet centrally and that respectively join the upper and lower slot portions. The sliding-bar linkage includes a double-pin bearing supporting the crosshead on the housing. The crosshead is level with the central intersection of the upper and lower legs. Thus the effective lever arm is at its shortest in the center of this turnaround area, minimizing inertia.

In order to accurately and surely guide the gripper shaft the sliding-action linkage includes two such slots and rollers at opposite axial ends of the shaft and the sliding-bar linkage includes two such rods, crossheads, and bearings also at opposite axial ends of the shaft. In addition the housing includes a transverse beam carrying the crossheads via the respective bearings.

The drive means according to this invention further comprises a drive shaft parallel to the gripper shaft, means for oscillating the drive shaft about its axis, respective cranks projecting radially from the drive shaft at the ends of the gripper shaft, and respective connecting rods between the cranks and the gripper rod. The drive shaft has a main input crank connected via another connecting rod to a drive actuator or motor. When an eccentric is used to oscillate the drive shaft the sinusoidally increasing and decreasing displacement speed will further decrease vibration in the machine.

DESCRIPTION OF THE DRAWING

The above and other features and advantages will become more readily apparent from the following, reference being made to the accompanying drawing in which.

SPECIFIC DESCRIPTION

Figure 1:
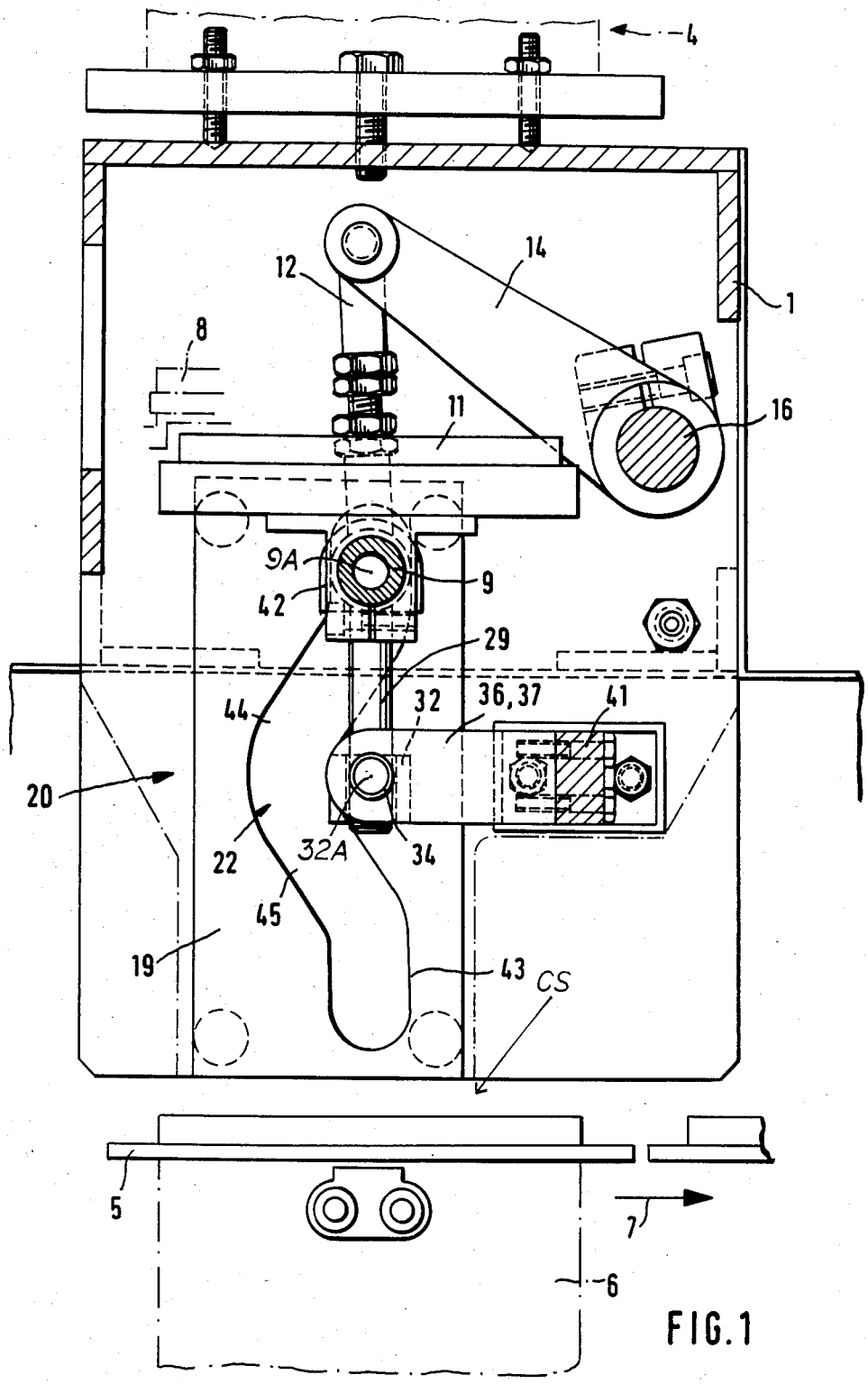
FIG. 1 is a longitudinal and vertical section through the apparatus according to this invention.

As seen in the drawing a capping machine according to this invention serves to put caps 8 stacked upside-down in a supply holder 4 onto vessels 6 moved stepwise by a conveyor belt 5 in a direction 7 through a capping station CS underneath the supply 4. Normally the vessels 5 are filled immediately upstream of the capping machine, that is to the left in FIG. 1.

Figure 2:
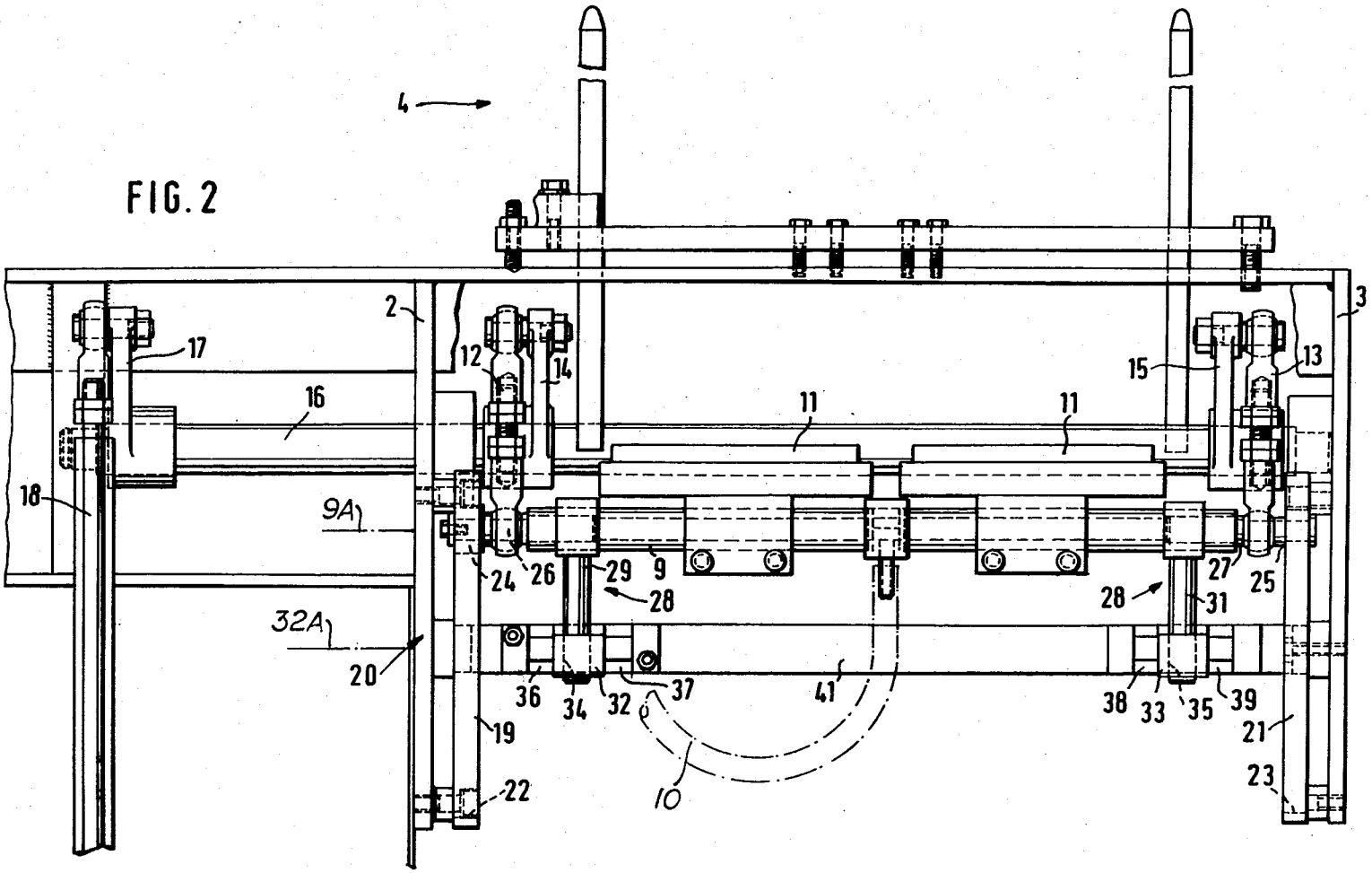
FIG. 2 is a transverse end view of the upper portion of the apparatus shown in FIG. 1.

The machine according to the invention has a housing 1 having a pair of side plates 2 and 3 that flank the conveyor 5 at the capping station CS. A tubular gripper shaft 9 extends along a horizontal axis 9A perpendicular to the direction 7 above the station CS. This shaft 9 carries as seen in FIG. 2 a pair of pneumatic suction-type grippers 11 connected via a hose 10 to a vacuum source.

The ends of the shaft 9 are secured in sliding-action guides or linkages 20 constituted as two guide plates 19 and 21 formed with respective guide slots 22 and 23 and secured to the sides 2 of the housing 1. The ends of the shaft 9 are provided with respective pins 26 and 27 which carry rollers 24 and 25 that fit snugly in the slots 22 and 23.

Journaled on the pins 26 and 27 plugging the ends of the shaft 9 are radially projecting arms 12 and 13 pivoted to the outer ends of respective crank arms 14 and 15 both carried on a main drive shaft 16 extending parallel to the shaft 9. Another crank 17 on a projecting end of this shaft 16 is connected via a rod 18 to an actuator, for instance an eccentric rotated synchronously with the conveyor drive, so that the shaft 16 is oscillated synchronously with the stepwise advance of the containers 6 on the belt 5. Thus the oscillation of the shaft 16 will be converted into a vertical reciprocation of the shaft 9 in the identical slots 22 and 23.

As seen in FIG. 1 the slot 22 has upper and lower portions 42 and 43 that are vertical and in line, and oppositely inclined central portions 44 and 45 between them. Thus as the shaft 16 oscillates to reciprocate the shaft 9 vertically, this shaft 9 will follow a generally straight vertical path, moving straight up and down at the ends of the stroke and deflecting slightly to the upstream side in the middle of the stroke.

In addition the shaft 9 has two slide-rod linkages 28 constituted by identical rod arms 29 and 31 projecting radially in the same direction from the ends of the shaft 9 and sliding in respective bores 34 and 35 of crossheads 32 and 33 carried on a traverse 41 of the housing 1 by respective bearing pairs 36, 37 and 38, 39 which are level with the intersection of the two inclined portions 44 and 45. These crossheads 32 and 33 can therefore rotate about an axis 32A parallel to the axis 9A. As mentioned above, the shaft 9 can rotate about the axis 9A relative to the link arms 12 and 13 so the angular position and motion of the shaft 9 and its grippers 11 are wholly determined by the relative angular positions of the axis 9a and the bearing axis 32A. The straight portions 42 and 43 allow the shaft 9 to move without rotation since when in these portions 42 and 43 there is no change in relative angular position of the axes 9A and 32A.

As the shaft 9 is displaced between the illustrated top end of its stroke and the bottom end thereof with the rollers 24 and 25 at the blind ends of the slot portions 43, this shaft 9 will move angularly through 180°. When in the illustrated upper position the arms 29 and 31 will extend vertically down through the crossheads 33 and when in the lower position they will extend oppositely upward.

The system therefore functions as follows:

As two vessels 6 are moved into the station the drive moves the shaft 9 into the illustrated uppermost position. In this position the grippers 11 are pressed against the lowermost caps 8 in the supplies 4 and cling thereto due to the vacuum connection. On downward movement of the shaft 9 the covers 8 held by the gripper are first pulled out of the bottoms of their stacks. Then, as the rod 9 is pushed along in the slot portions 44 and 45 so there is relative angular movement of the axes 9A and 32A, the rod 9 rotates through 180° to point the grippers 11 downward. As the shaft 9 moves to the very lowest end of the slots 22 and 23 the picked-up covers 8 are pressed down into the vessels 6.

The suction is then cut so the grippers 11 release the covers, and the shaft 9 is lifted back up, with inversion of the grippers 11 to pick up two more covers 8 as new uncovered vessels 6 are moved into the station CS. A new cycle can start.

I claim:

1. In an apparatus for putting caps on vessels, the apparatus having a housing defining a capping station;

conveyor means for transporting a longitudinally extending row of the vessels through the station;

a supply of the caps on the housing above the capping station;

a gripper shaft extending along a transverse shaft axis in station beneath the supply;

a gripper carried on the shaft; and drive means for rotating the shaft between one end position with the gripper engaged upward against the cap supply and an opposite end position with the gripper beneath the shaft and holding a cap picked off the supply above a vessel in the station, and for vertically displacing the shaft generally perpendicular to its axis between upper and lower positions, the improvement wherein the drive means for the shaft comprises a sliding-action linkage having a vertically extending guide slot formed in the housing and a roller carried on the shaft and snugly fitted in the slot for vertical guided displacement of the shaft and gripper, and a sliding-bar linkage connected between the shaft and the housing and including a rod fixed on and extending radially from the shaft and a crosshead pivotal on the housing and slidably receiving the rod for effecting its rotation.

2. The improved capping apparatus defined in claim 1 wherein the slot has straight and vertical upper and lower portions and a V-shaped center portion therebetween having inclined upper and lower legs that meet centrally and that respectively join the upper and lower slot portions.

3. The improved capping apparatus defined in claim 2 wherein the crosshead is level with the central intersection of the upper and lower legs.

4. The improved capping apparatus defined in claim 3 wherein the sliding-action linkage includes two such slots and rollers at opposite axial ends of the shaft and the sliding-bar linkage includes two such rods, crossheads, and bearings also at opposite axial ends of the shaft.

5. The improved capping apparatus defined in claim 4 wherein the housing includes a transverse beam carrying the crossheads via the respective bearings.

6. The improved capping apparatus defined in claim 5 wherein the drive means further comprises a drive shaft parallel to the gripper shaft;

means for oscillating the drive shaft about its axis;

respective cranks projecting radially from the drive shaft at the ends of the gripper shaft; and respective connecting rods between the cranks and the gripper rod.

7. The improved capping apparatus defined in claim 3 wherein the sliding-bar linkage includes a double-pin bearing supporting the crosshead on the housing.

8. A capping machine comprising:

a housing defining a capping station;

conveyor means for transporting a longitudinally extending row of such vessels through the station;

a supply of caps on the housing above the capping station;

a gripper shaft extending along a transverse shaft axis in station beneath the supply;

a gripper carried on the shaft;

a rod fixed on and extending radially from the shaft;

a crosshead pivotal on the housing and slidably receiving the rod;

a vertical guide slot formed in the housing;

a roller carried on the shaft and engaged in the slot, whereby the shaft is vertically reciprocal in the slot; and drive means connected between the shaft and the housing for vertically displacing the shaft along the slot between upper and lower positions, the rod and crosshead being constructed such that on such vertical displacement the shaft is rotated between one end position corresponding to the upper shaft position with the gripper engaged upward against the cap supply and an opposite end position corresponding to the lower shaft position with the gripper beneath the shaft and holding a cap picked off the supply above a vessel on the belt in the station.

9. The improved capping apparatus defined in claim 8 wherein the slot has straight and vertical upper and lower portions and a V-shaped center portion therebetween having inclined upper and lower legs that meet centrally and that respectively join the upper and lower slot portions.

10. The improved capping apparatus defined in claim 9 wherein the crosshead is level with the central intersection of the upper and lower legs.

11. The improved capping apparatus defined in claim 10 wherein the sliding-bar linkage includes a double-pin bearing supporting the crosshead on the housing.

12. The improved capping apparatus defined in claim 11 wherein the drive means further comprises a drive shaft parallel to the gripper shaft;

means for oscillating the drive shaft about its axis;

respective cranks projecting radially from the drive shaft at the ends of the gripper shaft; and respective connecting rods between the cranks and the gripper rod.

* * * * *